US010047747B2

(12) United States Patent
Kösters et al.

(10) Patent No.: US 10,047,747 B2
(45) Date of Patent: Aug. 14, 2018

(54) PUMP ASSEMBLY AND METHOD FOR EVACUATING A VAPOR-FILLED CHAMBER

(71) Applicant: Sterling Industry Consult GmbH, Itzehoe (DE)

(72) Inventors: Heiner Kösters, Itzehoe (DE); Matthias Tamm, Itzehoe (DE); Daniel Schütze, Itzehoe (DE)

(73) Assignee: Sterling Industry Consult GmbH, Itzehoe (DE)

( * ) Notice: Subject to any disclaimer, the term of this patent is extended or adjusted under 35 U.S.C. 154(b) by 300 days.

(21) Appl. No.: 14/762,005

(22) PCT Filed: Jan. 16, 2014

(86) PCT No.: PCT/EP2014/050807

§ 371 (c)(1),
(2) Date: Jul. 20, 2015

(87) PCT Pub. No.: WO2014/111471

PCT Pub. Date: Jul. 24, 2014

(65) Prior Publication Data

US 2015/0361979 A1 Dec. 17, 2015

(30) Foreign Application Priority Data

Jan. 21, 2013 (EP) ..... 13152022

(51) Int. Cl.
*F04C 19/00* (2006.01)
*F04C 29/04* (2006.01)
(Continued)

(52) U.S. Cl.
CPC ..... *F04C 19/004* (2013.01); *F04C 23/00* (2013.01); *F04C 25/02* (2013.01); *F04C 29/042* (2013.01);
(Continued)

(58) Field of Classification Search
CPC ..... F04C 19/001; F04C 19/004; F04C 23/00; F04C 25/02; F04C 29/042
(Continued)

(56) References Cited

U.S. PATENT DOCUMENTS 3,642,384 A * 2/1972 Huse ..... F04C 18/126 417/205
4,315,717 A * 2/1982 King ..... F04C 23/00 417/250
(Continued)

FOREIGN PATENT DOCUMENTS

DE 10214331 A1 10/2003
EP 1243795 B1 5/2004

OTHER PUBLICATIONS

International Search Report dated Mar. 14, 2014 (PCT/EP2014/050807).
(Continued)

*Primary Examiner* — Peter J Bertheaud
(74) *Attorney, Agent, or Firm* — Alix, Yale & Ristas, LLP

(57) ABSTRACT

The invention relates to an assembly comprising a vacuum pump and a chamber, wherein a suction tract extends between the chamber and the vacuum pump. The vacuum pump is a liquid ring machine. According to the invention, a liquid outlet is arranged in the suction tract in order to add liquid to gas sucked in from the chamber. The invention further relates to a method for evacuating a chamber filled with vapor. According to the invention, the vapor is condensed by introducing additional liquid into the suction tract, thus by co-condensation. By supplying liquid selectively only when liquid is required for the condensation of the vapor, water is saved.

17 Claims, 1 Drawing Sheet

(51) Int. Cl.
*F04C 23/00* (2006.01)
*F04C 25/02* (2006.01)
*F04C 28/10* (2006.01)

(52) U.S. Cl.
CPC ..... *F04C 19/001* (2013.01); *F04C 28/10* (2013.01); *F04C 2210/1077* (2013.01); *F04C 2220/10* (2013.01)

(58) Field of Classification Search
USPC ..... 417/54, 68
See application file for complete search history.

(56) References Cited

U.S. PATENT DOCUMENTS

| | | | | |
|---|---|---|---|---|
| 4,385,868 | A * | 5/1983 | King | F04C 23/00 417/250 |
| 4,914,921 | A * | 4/1990 | Knodel | F25B 1/00 417/68 |
| 6,485,545 | B1 | 11/2002 | Ohlrogge et al. | |
| 2011/0200450 | A1 | 8/2011 | Shelley et al. | |

OTHER PUBLICATIONS

Office Action dated Jun. 5, 2016 for Chinese Patent Application No. 201480005247.0.

* cited by examiner

PUMP ASSEMBLY AND METHOD FOR EVACUATING A VAPOR-FILLED CHAMBER

BACKGROUND

The invention relates to an assembly produced from a vacuum pump and a chamber where an intake tract extends between the chamber and the vacuum pump. The vacuum pump is a liquid ring machine. The invention also relates to a method for evacuating a vapor-filled chamber.

Autoclaves, as used, for instance, in hospitals for sterilizing, for example, hand towels, bedding or also instruments, belong to the applications where a vapor-filled chamber is evacuated. Hot vapor is introduced into the chamber for sterilizing purposes. Once the sterilization has been completed, the vapor is sucked out of the chamber of the autoclave such that the sterilized objects are able to be removed. The vapor as such cannot be simply output to the environment. In the process, the vapor is consequently condensed such that only the condensate remains.

A vacuum pump, which is connected to the chamber of the autoclave by means of an intake tract, is used to suck out the gas. In the case of assemblies up to now the intake tract is provided with a heat exchanger to condense the vapor, by way of which heat exchanger heat is removed from the vapor in a volume that ensures that the vapor condenses. The condensate is sucked in by the vacuum pump and output at atmospheric pressure.

Heat exchangers where the vapor to be condensed is guided past cooled plates are usual, for example, as heat exchangers in the intake tract. The disadvantage of such heat exchangers is that large volumes of water are necessary in order to achieve a low condensation temperature.

SUMMARY

The object underlying the invention is to propose an assembly and a method by way of which the vapor taken in from the chamber is able to be condensed in a more environmentally friendly manner. Proceeding from the named prior art, the object is achieved with the features of the independent claims. Advantageous embodiments are to be found in the sub-claims.

According to the invention, a liquid outlet is arranged in the intake tract in order to mix gas sucked out of the chamber with liquid.

The invention has recognized that by introducing liquid directly into the intake tract, the vapor is able to be condensed very effectively. Comparative tests, where one time a conventional heat exchanger was cooled with water and one time, according to the invention, water was supplied directly to the gas, have shown that it was possible to reduce the water consumption by approximately 50%.

Vacuum pumps are designed to suck gas out of a chamber in order to generate a vacuum in the chamber. The medium to be conveyed is therefore gaseous when a vacuum pump in used in the normal manner. In general, vacuum pumps are sensitive when they suck in volumes of liquid instead of a purely gaseous medium. The proposal according to the invention to increase the liquid volume in the gas flow in a targeted manner by adding liquid into the intake tract is unexpected in this respect. The invention, however, has recognized that, using a liquid ring vacuum pump, it is possible to transport the necessary liquid volume which is produced from the condensate and the additionally introduced liquid. In this case, the suitability of the vacuum pump to convey liquid can be improved by the inlet opening and/or the outlet opening of the vacuum pump having an enlarged cross section compared to a vacuum pump which is optimized purely for conveying gas. In spite of such a modification, the intake capacity remains substantially the same such that the vacuum pump continues to be capable of generating and maintaining the desired low pressure in the chamber.

Low pressure in the chamber is desired in particular because when the pressure is low, the objects in the chamber are able to be dried within a short time following the sterilization. When the pressure is low, the moisture evaporates and can then be sucked up by way of the vacuum pump. The drying is effected all the quicker, the lower the pressure in the chamber. The vacuum pump can be designed for the purpose of generating a vacuum in the chamber of less than 150 mbar, preferably less than 100 mbar, further preferably less than 70 mbar. As a rule, evacuation at less than 30 mbar is not necessary.

For effective condensation of the vapor, it is advantageous when there is large-area contact between the vapor and the liquid supplied into the intake tract. It is, therefore, advantageous when the liquid is supplied in the form of small drops. The liquid outlet can consequently be provided with a spray opening. The liquid is then not output in the form of a concentrated jet, but is distributed such that there is intensive interaction with the vapor.

The liquid outlet can be arranged in a line which extends between the chamber and the vacuum pump. It is also possible for the liquid outlet to be incorporated into the vacuum pump. The liquid outlet can open out in the intake region of the vacuum pump, that is, for example, in the suction piece or in the intake space that is arranged in front of the operating chamber. The liquid is preferably supplied before the gas flow enters into the operating chamber of the vacuum pump. The intake tract includes the region between the pump and the chamber in which there is negative pressure when the pump is operating.

The liquid volume, which is produced from the condensate and the liquid supplied to the intake tract, is conveyed through the vacuum pump and exits again on the output side of the vacuum pump. In this case, it cannot be ruled out that the entrained liquid and the operating liquid which forms the liquid ring are mixed in the vacuum pump and then a different liquid volume exits the vacuum pump than has entered the vacuum pump with the gas flow.

A separator, in which liquid volumes conveyed by the vacuum pump can be collected, can connect to the output of the vacuum pump. The separator can be provided with an overflow, by means of which excessive liquid is output. Gas volumes which remain over once the liquid has been separated can be output to the environment.

In order to keep liquid consumption down, it is possible to provide a return line which extends from the outlet side of the vacuum pump up to the liquid outlet. It is not then necessary to use fresh liquid in each case for condensing the vapor, but liquid which has already run once through the vacuum pump can be used. The separator is regarded as part of the output side. The return line can therefore be connected to the separator.

The vacuum pump can additionally comprise an inlet for supplying operating liquid. The operating liquid forms the liquid ring when the vacuum pump is operating. In an advantageous embodiment, the inlet for the operating liquid is also connected to the return line such that the operating liquid can also be guided in a closed circuit.

As a result of the condensation of the vapor, heat is transmitted such that the liquid heats up. Temperatures of the liquid above a maximum outlet temperature, typically 60° C., are undesirable because liquids above said temperature can no longer be disposed of simply with the waste water. The assembly can include a fresh water connection for this purpose such that cooler liquid at, for example, room temperature can be supplied, where required, to the intake tract and/or to the operating chamber of the vacuum pump. Conversely, the hotter liquid can be output by means of the separator such that the temperature of the liquid situated in the system drops overall.

The fresh water connection can additionally be used in order to lower the temperature of the liquid in the system when the pressure on the inlet side of the vacuum pump is low. If, for example, the operating liquid is at a temperature of 60° C., there is the risk of cavitation at pressures which are below approximately 100 mbar. If, in contrast, the temperature of the operating liquid is 20° C., pressures of, for example, 50 mbar are also possible without cavitation.

The fresh water connection can be connected to the return line. A non-return valve can be arranged in the return line between the fresh water connection and the outlet side of the vacuum pump. Liquid flowing out of the fresh water connection is then supplied to the liquid outlet and/or to the inlet for operating liquid without the liquid used being mixed beforehand. If, in contrast, no liquid comes out of the fresh water connection, the non-return valve opens and the liquid can flow in an unobstructed manner from the outlet side of the vacuum pump by means of the return line to the liquid outlet and/or to the inlet for the operating liquid.

In an advantageous embodiment, the fresh water connection is provided with a switching valve, by means of which the inflow of liquid from the fresh water connection is able to be adjusted. A control means can be provided and the switching valve can be controlled by said control means. The control means can be connected to a temperature sensor for the temperature of the liquid in the system. The control means can be designed such that it opens the switching valve when the temperature exceeds a predefined threshold. The threshold can be, for example, 60° C. because only liquid at a temperature below said threshold is able to be disposed of easily by means of the waste water.

When the liquid is moved via the return line in a closed circuit, the temperature sensor can be arranged at an arbitrary point of the system. The temperature can therefore be measured, for example, inside the vacuum pump, in the return line, in the separator or in another part of the liquid circuit. The advantage of measuring the temperature at the outlet of the vacuum pump or in the separator is that the temperature of the liquid that is output as waste water is measured in a substantially direct manner.

The control means can additionally be connected to a pressure sensor for the pressure in the intake tract and can be set up such that it opens the switching valve when the pressure drops below a predefined threshold. The threshold can be between 80 mbar and 200 mbar, preferably between 100 mbar and 150 mbar. When the pressure drops below the threshold, a lower temperature of the liquid in the system is advantageous because the risk of cavitation is reduced as a result. When the switching valve is opened, cool liquid flows into the system such that the temperature of the liquid, in particular of the operating liquid, drops.

The control means can additionally be designed such that it closes the switching valve again when a predefined liquid volume has been supplied from the fresh water connection. The liquid volume can be measured, for example, such that the liquid in the system is replaced substantially completely by fresh liquid. The predefined liquid volume can be between 5 l and 15 l, for example.

According to a further aspect, the control means can be designed such that it opens the switching valve at a moment at which the vacuum pump is not operating. Triggers for this can be, for example, a control signal which the control means receives. Supplying liquid to the intake tract although the vacuum pump is not active can be of interest, for example, whenever the pressure in the chamber is higher than atmospheric pressure and the vapor consequently flows on its own in the direction of the vacuum pump.

The chamber of the assembly according to the invention can be the chamber of an autoclave. The chamber can comprise a closable opening, through which the objects to be sterilized can be introduced into the chamber. In the closed state, the chamber is sealed such that it is able to be placed under overpressure. During the sterilizing process, the pressure in the chamber can be, for example, between 2 bar and 4 bar. All the pressure specifications relate to absolute pressure.

The operating liquid and the liquid which is supplied through the liquid outlet is normally water. The water from the fresh water connection can be at room temperature, for example, and consequently be cooler than the water in the system when the vacuum pump is active. If the liquid in the system is a liquid other than water, the fresh water connection can also be designed for the purpose of supplying the corresponding liquid.

The invention additionally relates to a method for evacuating a chamber filled with vapor. In the case of the method, a vacuum pump, which is connected to the chamber by means of an intake tract, is operated in order to suck the vapor out of the chamber. The liquid is supplied to the gas flow in the intake tract such that the vapor condenses.

The liquid can be returned to the intake tract from the outlet of the vacuum pump. In an advantageous embodiment, the fluid is returned whenever the pressure in the intake tract is above a predefined threshold and when the temperature of the liquid at the outlet of the vacuum pump is below a predefined threshold. Fresh water can be supplied to the intake tract when the pressure in the intake tract drops below the predefined threshold. Fresh water can additionally be supplied to the intake tract when the temperature of the liquid at the outlet of the vacuum pump exceeds the predefined threshold.

The method can be further developed with further features which are described with reference to the assembly according to the invention.

BRIEF DESCRIPTION OF THE DRAWINGS

The invention is described below by way of advantageous exemplary embodiments with reference to the accompanying drawings, in which.

DETAILED DESCRIPTION

Figure 1:
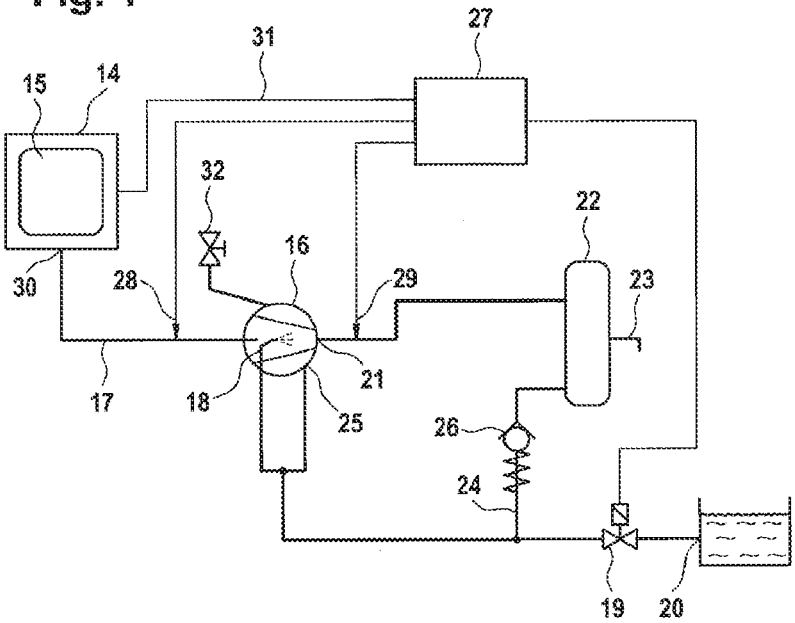
FIG. 1 shows a schematic representation of an assembly according to the invention.

An assembly according to the invention in FIG. 1 includes an autoclave 14, as is used, among other things, in hospitals in order to sterilize clothing, hand towels, bedding or also instruments. The autoclave 14 includes a chamber 15 which is able to be closed such that it is tight. The chamber 15 can therefore be placed under overpressure or vacuum.

Figure 2:
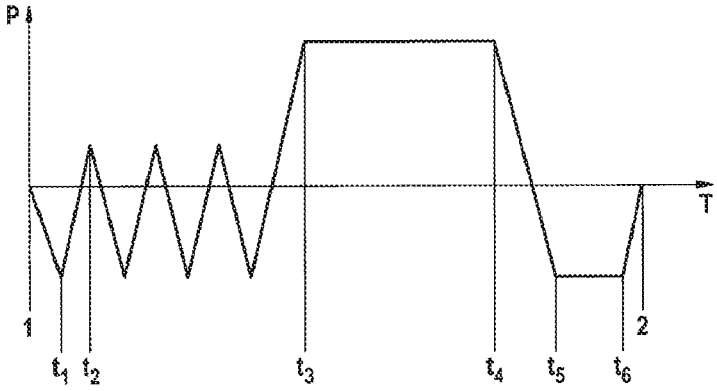
FIG. 2 shows a schematic representation of a sterilization cycle.

A sterilization cycle taking hand towels as an example is explained by way of FIG. 2. In the diagram in FIG. 2, the pressure P in the chamber 15 is applied over the time T. In the initial state, there is atmospheric pressure of approximately 1 bar in the chamber 15. A flap, not shown in FIG. 1, is opened and the hand towels are placed into the chamber 15.

The chamber is evacuated to a pressure of approximately between 100 mbar and 120 mbar up to the moment t1. This sucks the germ-containing air out of the chamber 15. A blast of vapor follows by way of which the chamber 15 is filled completely with vapor between the moments t1 and t2. In this case, the pressure in the chamber 15 easily rises beyond atmospheric pressure. The chamber 15 is then evacuated again between 100 mbar and 120 mbar. Two further vapor blasts are effected with subsequent evacuation. The effect of vapor blasts serves the purpose of relieving the chamber 15 reliably and completely of the residues of the original germ-containing air.

In the following expansion period, which extends up to the moment t3, the chamber 15 is once more filled with vapor, a pressure being generated this time which is clearly above atmospheric pressure. The absolute pressure at the moment t3 can be, for example, 3 bar. The actual sterilization, which can extend over 40 min for example, takes place between the moments t3 and t4. Germs and pathogens in the hand towels are rendered harmless as a result of the increased pressure and the vapor atmosphere at a temperature of approximately 140° C.

At the moment t4 a valve is opened such that the vapor is able to escape out of the chamber 15. The pressure drops to atmospheric pressure over a period of approximately 1 min. Over a period of approximately a further minute, the chamber is evacuated to a pressure of approximately 50 mbar. The pressure at the moment t5 is therefore clearly less than the pressure after the moment t1.

The pressure of 50 mbar is held for a period of approximately 20 min. The moisture in the hand towels evaporates completely in this time period such that the hand towels are dry at the moment t6. The chamber 15 is then brought back to atmospheric pressure, whereby the sterilization cycle is concluded at the moment 2. The hand towels can be removed from the chamber 15 and are ready for further use.

The negative pressure in the chamber 15 necessary for the sterilization cycle is generated by means of a liquid ring vacuum pump 16 which is connected to the chamber by means of an intake tract 17. The intake tract 17 includes a line which extends between the chamber 15 and the liquid ring vacuum pump 16, as well as the inlet region of the vacuum pump 16 which is arranged in front of the operating chamber. An outlet valve 30 is arranged at the transition between the chamber 15 and the intake tract 17.

A spray head 18, which forms a liquid outlet in terms of the invention, is arranged in the inlet region of the vacuum pump 16. The spray head 18 is connected to a fresh water connection 20 by means of a switching valve 19. When the switching valve 19 is open, water emerges from the spray head 18 in a finely distributed form and is distributed in the intake tract 17. An inlet 25 for the operating liquid of the vacuum pump 16 is connected to the same feed line. When the vacuum pump is active, the operating liquid forms the liquid ring which seals the impeller wheel in relation to the housing.

When the liquid ring vacuum pump 16 is active, the liquid supplied from the spray head 18, together with the medium sucked from the chamber 15, is conveyed to the outlet side 21 of the vacuum pump 16. The liquid and the gaseous constituents of the conveyed medium are separated from one another in a separator 22 and the gaseous constituents are output to the environment. Excessive water is output by means of an overflow 23.

A return line 24 extends from the separator 22 in the direction of the spray head 18 and of the inlet 25 for the operating liquid. A non-return valve 26 is arranged in the return line 24. When the switching valve 19 is open, the fresh water exits at a pressure which is higher than the pressure in the separator 22. The non-return valve 26 closes such that the fresh water can only flow in the direction of the vacuum pump 16 and not into the separator 22. If the switching valve 19 is closed, the non-return valve 26 opens and the liquid from the separator 22 is able to flow in the direction of the vacuum pump 16. There is then a closed circuit from the vacuum pump 16 via the separator 22 and the return line 24 back to the vacuum pump 16.

The switching valve 19 is connected to a control means 27 such that the switching valve 19 opens or closes according to control instructions from the control means 27. The control means 27 receives measuring signals from a pressure sensor 28 and a temperature sensor 29. The pressure sensor 28 measures the pressure in the intake tract 17 and is designed for the purpose of outputting a control signal when the pressure in the intake tract drops below 100 mbar. The temperature sensor 29 measures the temperature of the medium exiting from the vacuum pump 16 and is designed for the purpose of outputting a control signal when the temperature of the emerging medium exceeds the maximum admissible outlet temperature (e.g. 60° C.). The control means 27 is designed such that it opens the switching valve 19 when it receives a control signal from one of the sensors 28, 29.

At the start of the sterilization cycle, at the moment 1, the outlet valve 30 is opened and the vacuum pump 16 is activated. The vacuum pump 16 sucks the air out of the chamber 15 and evacuates the chamber 15 up to a pressure of approximately 120 mbar. If the pressure of approximately 120 mbar is reached, the outlet valve 30 is closed and vapor is admitted into the chamber 15 from a nozzle of the autoclave 14 (not shown). The temperature of the operating liquid in this phase can be between 50° C. and 60° C. As long as the pressure remains above 120 mbar, cavitation does not occur in the vacuum pump 16 in spite of said temperature of the operating liquid. Excessive liquid volumes can still be disposed of by means of the normal waste water at said temperatures.

At the moment t2, the outlet valve 30 is opened again and the vacuum pump 16 begins with the evacuating process. Vapor is then sucked out of the chamber 15. The vapor which, in a hospital, cannot simply be output into the environment, has to be condensed. In the assembly according to the invention, this occurs as a result of liquid being sprayed into the intake tract 17. The vapor comes into contact with the liquid and is cooled such that it is almost completely condensed. The assembly according to the invention therefore functions as a mixing condenser.

If the vacuum pump 16 starts to function proceeding from the moment t2, the pressure in the intake tract 17 drops below atmospheric pressure within a short time. As a result of the negative pressure, water that enters into the intake tract 17 by means of the spray head 18 is sucked out of the separator 22. The interaction between the sprayed-in water and the vapor takes place substantially prior to entry into the working space of the vacuum pump 16, which means that the vacuum pump conveys primarily water. Said operation with the introduction of vapor blasts and subsequent evacuation with condensation of the vapor is repeated twice.

The pressure in the intake tract 17 is continuously above 100 mbar in said phase such that the threshold at which the pressure sensor 28 outputs a control signal is not fallen below. As long as the temperature of the water emerging from the vacuum pump 16 remains below 60° C., the temperature sensor 29 does not output a control signal. The switching valve 19 therefore remains closed. The water flows in a closed circuit from the vacuum pump 16 via the separator 22 and the return line 24 back to the vacuum pump, excessive water continuously being removed by means of the overflow 23. The excessive water results primarily from the condensate of the vapor coming from the chamber 15.

As a result of the condensation of the vapor, heat is regularly supplied to the liquid such that the temperature of the liquid in the system continually rises. As soon as the threshold of 60° C. has been exceeded, the temperature sensor 29 outputs a control signal and the switching valve 19 of the fresh water connection 20 is opened. Cold water at a temperature of, for example, 20° C. then enters the system whilst the heated water exits the system by means of the overflow 23. The control means 27 is programmed such that it closes the switching valve 19 again when the liquid in the system has essentially been completely replaced once. If the liquid volume in the system is, for example, approximately 10 l, the switching valve 19 can be closed again once said volume of fresh water has been supplied. Once the water has been replaced, the closed circuit begins anew with fresh water.

During the expansion time and during the actual sterilization, the switching valve 30 remains closed and the vacuum pump 16 non-operational. Once the sterilization has been completed, at the moment t4 the outlet valve 30 is opened. The pressurized vapor exits from the chamber 15 such that the pressure inside the chamber 15 drops to atmospheric pressure within approximately 1 min. A little above atmospheric pressure, the vacuum pump 16 is activated such that the evacuation is rapidly introduced.

The vapor in the intake tract 17 is to condense even before the vacuum pump is started up. The control means 27 consequently receives a control signal via a line 31 as soon as the outlet valve 30 is opened at the moment t4. As a result of an instruction from the control means 27, the switching valve 19 is opened such that fresh water flows in the direction of the spray head 18. The pressure of the public water supply is generally 4 bar and consequently higher than the pressure in the chamber 15. The normal water pressure is therefore sufficient to spray the water into the intake tract 17. If the water pressure is not sufficient in the individual case, it can be increased by suitable means.

As long as overpressure prevails in the chamber 15, the sprayed-in water is pressed through the vacuum pump 16 together with the condensate even when the vacuum pump 16 is not active. The overpressure, therefore, builds up on its own.

When the vacuum pump is activated just above atmospheric pressure, the switching valve 19 is initially closed. The system is essentially completely filled with fresh water such that the water can be guided for a time in the closed circuit before the limit of 60° C. is exceeded at the outlet of the vacuum pump 16. If the water has been heated repeatedly to said value, the temperature sensor 29 outputs a control signal and the heated water is replaced by fresh water.

If the chamber 15 is evacuated up to 100 mbar, the pressure sensor 28 outputs a control signal. The switching valve 19 opens and the system is filled with fresh water. This serves for avoiding cavitation which would be expected if, at a water temperature of around 60° C., the pressure were less than 100 m mbar. Air can be admitted into the vacuum pump 16 by means of a valve 32 in order to reduce further the risk of cavitation.

Using the fresh water with which the system is now filled, further evacuation is effected up to the final pressure of 50 mbar. In the drying phase, in which said low pressure is maintained, fresh water is supplied in each case in a volume that ensures that the water in the system is held approximately at room temperature.

By supplying fresh water in a targeted manner only whenever it is necessary for the condensation of the vapor or for the operation of the pump, a considerable volume of water is saved compared to conventional processes.

The invention claimed is:

1. An assembly produced from a vacuum pump (16) and a chamber (15) comprising an intake tract (17) extending between the chamber (15) and the vacuum pump (16), wherein the vacuum pump (16) is a liquid ring machine and a liquid outlet (18) is incorporated into the vacuum pump (16) in order to mix gas sucked out of the chamber (15) with liquid, and a fresh water connection (20) with a switching valve (19) controlled by a control means (27) is configured for supplying a liquid to one or more of the liquid outlet (18) and an inlet (25) for vacuum pump operating liquid.

2. The assembly of claim 1, wherein the vacuum pump (16) is designed for the purpose of generating a vacuum of less than 150 mbar.

3. The assembly of claim 1, wherein the liquid outlet (18) includes a spray opening.

4. The assembly of claim 1, wherein a separator (22) connects to an output side (21) of the vacuum pump (16) in order to collect liquid volumes conveyed by the vacuum pump (16).

5. The assembly of claim 1, wherein a return line (24), which extends from an outlet side (21) of the vacuum pump (16) as far as the liquid outlet (18), is provided for the liquid.

6. The assembly of claim 5, wherein the vacuum pump (16) includes the inlet (25) for supplying the vacuum pump operating liquid and in that the inlet (25) is connected to the return line (24).

7. The assembly of claim 1, wherein the fresh water connection (20) opens out in a return line (24) and in that a non-return valve (26) is arranged in the return line (24) between the fresh water connection (20) and an outlet side (21) of the vacuum pump (16).

8. The assembly of claim 1, wherein the control means (27) is connected to a temperature sensor (29) for a temperature of the liquid and in that the control means (27) is designed for the purpose of opening the switching valve (19) when the temperature exceeds a predefined threshold.

9. The assembly of claim 1, wherein the control means (27) is connected to a pressure sensor (28) for a pressure in the intake tract (17) and in that the control means (27) is designed for the purpose of opening the switching valve (19) when the pressure drops below a predefined threshold.

10. The assembly of claim 8, wherein the control means (27) is connected to a pressure sensor (28) for a pressure in the intake tract (17) and in that the control means (27) is designed for the purpose of opening the switching valve (19) when the pressure drops below a predefined threshold.

11. The assembly of claim 2, wherein the liquid outlet (18) includes a spray opening.

12. The assembly of claim 1, wherein the vacuum pump (16) is designed for the purpose of generating a vacuum of less than 100 mbar.

13. A method for evacuating a chamber (15) filled with vapor comprising a vacuum pump (16), which is connected to the chamber (15) by an intake tract (17), said vacuum pump being operated in order to suck the vapor out of the chamber (15), wherein a liquid is supplied through a liquid outlet (18) incorporated into the vacuum pump (16) such that the vapor condenses, and a fresh water connection (20) with a switching valve (19) controlled by a control means (27) is configured for supplying a liquid to one or more of the liquid outlet (18) and an inlet (25) for vacuum pump operating liquid.

14. The method of claim 13, wherein the liquid is returned to the intake tract (17) from an outlet of the vacuum pump (16) when a pressure in the intake tract (17) is above a predefined threshold (17) and when a temperature of the liquid at the outlet (21) of the vacuum pump (16) is below a predefined threshold.

15. The method of claim 14, wherein fresh water is supplied to the intake tract (17) when the pressure in the intake tract (17) drops below a predefined threshold.

16. The method of claim 14, wherein fresh water is supplied to the intake tract (17) when the temperature of the liquid at the outlet (21) of the vacuum pump (16) exceeds the predefined threshold.

17. The method of claim 15, wherein fresh water is supplied to the intake tract (17) when the temperature of the liquid at the outlet (21) of the vacuum pump (16) exceeds the predefined threshold.

* * * * *